US005785148A

United States Patent [19]

Wildner

[11] Patent Number: 5,785,148

[45] Date of Patent: Jul. 28, 1998

[54] ENVIRONMENTALLY SAFE WORK PLATFORM WITH BUOYANCY SYSTEM

[76] Inventor: Robert J. Wildner, R.D. 2, Box 347A, Johnstown, Pa. 15904

[21] Appl. No.: 641,283

[22] Filed: Apr. 30, 1996

Related U.S. Application Data

[60] Division of Ser. No. 391,515, Feb. 21, 1995, which is a continuation-in-part of Ser. No. 340,306, Nov. 14, 1994, Pat. No. 5,484,035, and Ser. No. 172,925, Dec. 27, 1993, Pat. No. 5,417,301.

[51] Int. Cl.[6] ..... E04G 3/10

[52] U.S. Cl. ..... 182/138; 182/63.1; 182/143

[58] Field of Search ..... 182/138, 150, 182/141, 63.1, 143

[56] References Cited

U.S. PATENT DOCUMENTS

| | | |
|---|---|---|
| 862,165 | 1/1907 | DEX . |
| 2,579,605 | 12/1951 | Odot . |
| 3,076,522 | 2/1963 | Goodell . |
| 3,614,993 | 10/1971 | Penso . |
| 3,638,757 | 2/1972 | Sampson . |
| 3,858,688 | 1/1975 | Galloway . |
| 3,891,055 | 6/1975 | Medlock . |
| 3,937,301 | 2/1976 | Bertail . |
| 4,153,000 | 5/1979 | Henderson . |
| 4,429,764 | 2/1984 | Park . |
| 4,529,063 | 7/1985 | Kishi . |
| 4,614,251 | 9/1986 | Hawkins . |
| 4,660,680 | 4/1987 | Potin . |
| 4,741,413 | 5/1988 | Kishi . |
| 4,846,357 | 7/1989 | Sholl et al. . |
| 4,848,516 | 7/1989 | Nakai et al. . |
| 4,852,307 | 8/1989 | Goudeau . |
| 4,930,598 | 6/1990 | Murrill et al. . |
| 4,944,366 | 7/1990 | Pryor et al. . |
| 4,962,828 | 10/1990 | Duncan . |
| 4,967,733 | 11/1990 | Rousseau . |
| 5,007,501 | 4/1991 | Baston . |
| 5,011,710 | 4/1991 | Harrison . |
| 5,065,838 | 11/1991 | Finley . |
| 5,203,428 | 4/1993 | Beeche . |
| 5,216,773 | 6/1993 | Haakonsen . |
| 5,299,655 | 4/1994 | Margaritis . |
| 5,417,301 | 5/1995 | Wildner . |
| 5,427,199 | 6/1995 | Jorgensen . |

*Primary Examiner*—Alvin C. Chin-Shue
*Attorney, Agent, or Firm*—Banner & Witcoff, Ltd.

[57] ABSTRACT

A work platform assembly is modular in construction so as to be configurable according to the configuration and size, particularly width, requirements of each bridge and to metal surfaces thereof which are to be reconditioned by abrasive stripping and recoating. The assembled platform is suspendable at each end by suspension frame assemblies which are rollable along the parapets of the bridge for repositioning the platform assembly, with the suspension assembly being adjustable to various configurations of parapets. An adjustable curtain frame enables sealed enclosure of bridge surfaces to be treated and optimum access of workers to those surfaces during the treatment. Airborne residue is evacuated by vacuum for subsequent disposal in a manner which does not contaminate the environment, while heavier residue and spent abrasive grit is collected and positively moved off of the platform assembly for subsequent, environmentally safe separation and reconstitution of the grit for reuse. The work platform assembly includes a floatation system which permits the work platform assembly to float in a body of water. The floatation system facilitates the maneuvering of the work platform assembly to better access surfaces to be treated. Additionally, the floatation system of the work platform assembly facilitates the transportation of the work platform assembly to a structure located above a body of water.

16 Claims, 8 Drawing Sheets

ENVIRONMENTALLY SAFE WORK PLATFORM WITH BUOYANCY SYSTEM

CROSS-REFERENCES TO RELATED APPLICATIONS

This application is a division of copending U.S. patent application Ser. No. 08/391,515, filed Feb. 21, 1995 which is (i) a continuation-in-part of U.S. patent application Ser. No. 08/172,925 filed Dec. 27, 1993 now U.S. Pat. No. 5,417,301, issue May 23, 1996 entitled ENVIRONMENTALLY SAFE WORK PLATFORM, and (ii) a continuation-in-part of U.S. patent application Ser. No. 08/340,306 filed Nov. 14, 1994, now U.S. Pat. No. 5,484,035, issue Jan. 16, 1996 entitled TRAILER AND ENVIRONMENTALLY SAFE WORK PLATFORM SYSTEM, both of which are hereby incorporated by reference.

BACKGROUND OF THE INVENTION

The invention is in the field of maintenance of steel bridge supports and other structures located above bodies of water. More specifically, the invention is directed to platforms from which workers can treat metal surfaces on the undersides and tops of the bridges and other structures, particularly during removal of rust and paint by blasting the metal surfaces with particles.

OSHA regulations provide stringent requirements for containment of any debris resulting from such treatment and capable of contaminating the surrounding environment, both during and after the treatment. Further, from an economic standpoint, it is preferable to collect, clean and reuse the particles used in abrasive blasting. However, because of physical constraints associated with the structures having the surfaces to be treated, many existing work platforms have been difficult to maneuver adjacent the surfaces. Previously, these physical constraints have required the work platforms to be manipulated and repositioned in a manner which was costly and time consuming, or otherwise undesirable.

Additionally, many existing work platforms are difficult to transport to some of the structures having surfaces to be treated. Transporting a work platform to, and positioning the work platform adjacent, structures located in water, e.g., bridges, have resulted in exceptional difficultly. To accomplish this task, a work platform may be mounted to a barge, and a large engine-driven tow boat or tug boat is attached to the barge for towing the barge to the structure. The barge is towed to a location adjacent the structure. The platform is uncoupled from the barge, and lifted off of the barge by a cable suspension system attached to the structure. However, this method can be expensive as it requires renting or purchasing a barge and a tug boat, and the hiring of a marine operator licensed to drive the boat. Further, this method can be time consuming, as available scheduling times for the boat, the barge, or the operator, may be limited to inopportune times, causing time delays. This can be extremely disadvantageous when attempting to treat the structure by a contractual deadline.

SUMMARY OF THE INVENTION

Thus, an object of the invention is to provide a work platform assembly upon which workers are supported so that they can stand and walk to address the metal surfaces to be stripped and recoated, while improving upon previous attempts at containing and collecting the contaminating airborne debris and heavier, spent particles in a manner which is safe for the environment. Such, an assembly is disclosed in copending U.S. patent application Ser. Nos. 08/172,925 and 08/340,306, respectively filed Dec. 27, 1993 and Nov. 14, 1994, which have been incorporated herein by reference.

Another object of the invention is to provide a work platform assembly which facilitates the maneuvering of the work platform assembly to better access surfaces to be treated. This especially facilitates the treatment of bridge decks or other structures when the structure is located above a body of water.

Yet another object of the invention is to provide a work platform assembly which floats in water to facilitate the transportation of the work platform assembly to a structure located above a body of water.

It is a further object to minimize the need to depend on a barge, a tug boat, and a tug boat operator when transporting the work platform assembly to a structure positioned above a body of water.

It is another object of the invention is to provide a work platform assembly which floats in water, permitting surfaces of a structure located above a body of water to be treated while the work platform assembly is floating in the body of water.

These and other objects are achieved by the present invention which, according to one aspect, provides a work platform assembly positionable at and spanning an underside of a structure located above a body of water to provide worker support and access to and treatment of surfaces of the structure. The work platform assembly includes a body, a trough for collecting particulate material, worker supporting structure positioned atop the trough for supporting a worker thereon, and a conveyor system for discharging the particulate material from the trough. The work platform assembly further includes a buoyancy system structurally coupled to the body providing the work platform assembly with sufficient buoyancy to permit the work platform assembly to float in the body of water below the surface to be treated. The buoyancy system includes at least one floatation member transportable with the work platform assembly to a position adjacent the surface to be treated.

In a second aspect, the invention provides a work platform assembly positionable at and spanning an underside of a structure located above a body of water to provide worker support and access to and treatment of surfaces of the structure. The work platform assembly includes at least first and second connected modules. The modules each include a frame, connecting structure for connecting the modules together side-to-side by connecting corresponding frames of the modules together side-to-side, a trough attached to the frame and extending longitudinally of the module, worker supporting structure positioned atop the trough for supporting a worker thereon, and a conveyor system for discharging the particulate material from the trough. The work platform assembly further includes a buoyancy system structurally coupled to at least one the modules providing the work platform assembly with sufficient buoyancy to permit the work platform assembly to float in the body of water below the surface to be treated. The buoyancy system includes at least one floatation member transportable with the work platform assembly to a position adjacent the surface to be treated.

In another aspect, the invention provides a method of treating surfaces on the underside of a structure located above a body of water. A work platform assembly is provided adjacent a first surface on an underside of the structure to provide worker support and access to and treatment of surfaces of the structure. The work platform assembly having a buoyancy enabling itself to float in water. The first surface is treated by projecting particles thereon. The work platform assembly is lowered from a position adjacent the first surface to a position adjacent the body of water, and floated directly on the body of water. The floating work platform assembly is translationally moved with respect to the structure, and raised to a position adjacent a second surface of the structure. The second surface is treated by projecting particles thereon.

Further preferred features and advantages of the present invention will appear from the following detailed description given by way of example of a preferred embodiment illustrated with reference to the accompanying drawings.

DETAILED DESCRIPTION OF THE INVENTION

Figure 1:
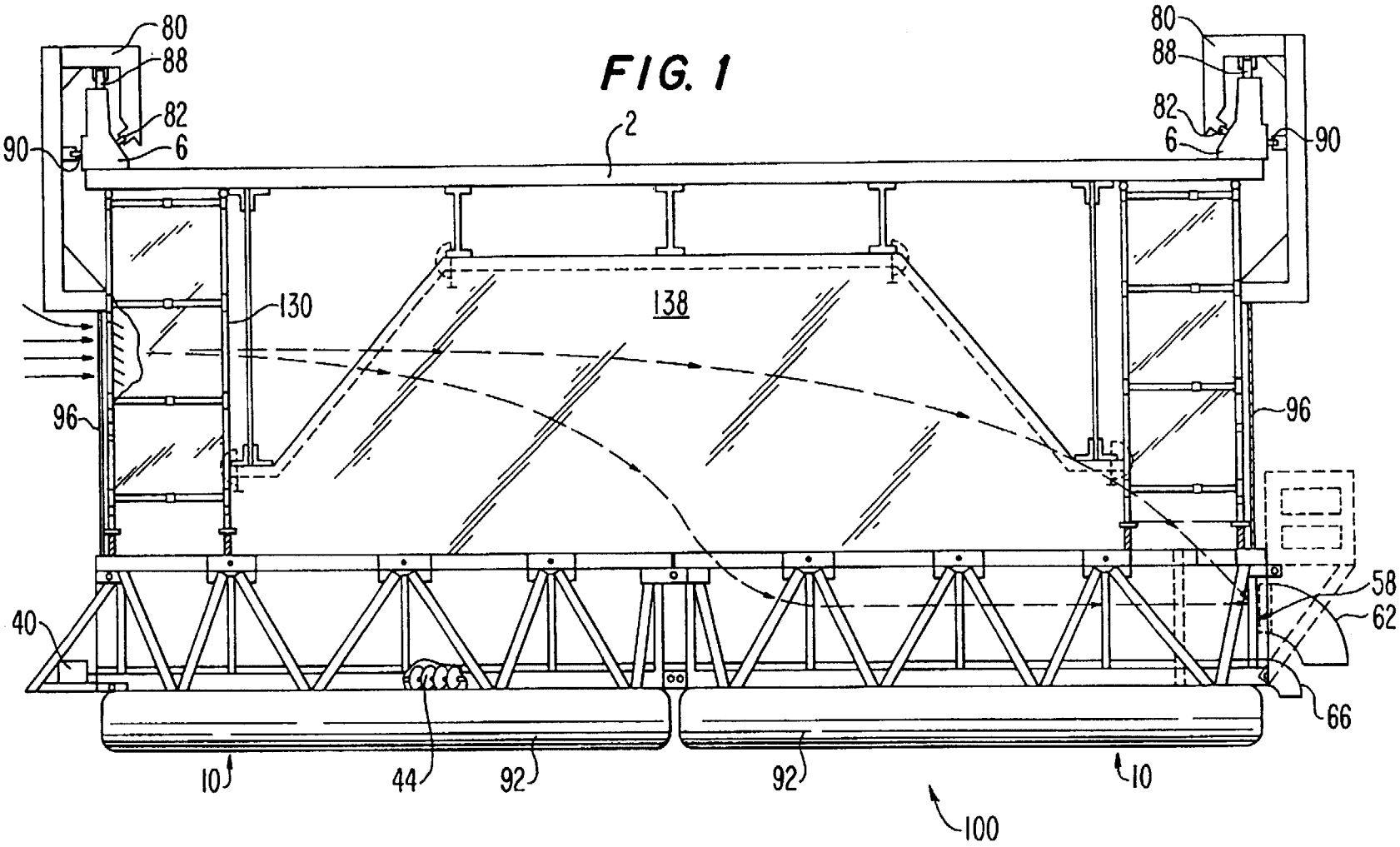
FIG. 1 is an elevational view of the work platform assembly of the invention in an operational, suspended position beneath a bridge, with its floatation devices attached thereto.

An environmentally safe work platform assembly of the present invention, as pictured in FIGS. 1–15, is respectively designated generally by reference numeral 100. At the outset, it should be noted that an abridged description of environmentally safe work platform assembly 100 is provided herein. Additional details directed to the structure and use of work platform assembly 100 are included in copending U.S. patent application Ser. Nos. 08/172,925 and 08/340,306, which have been incorporated herein by reference.

Figure 2:
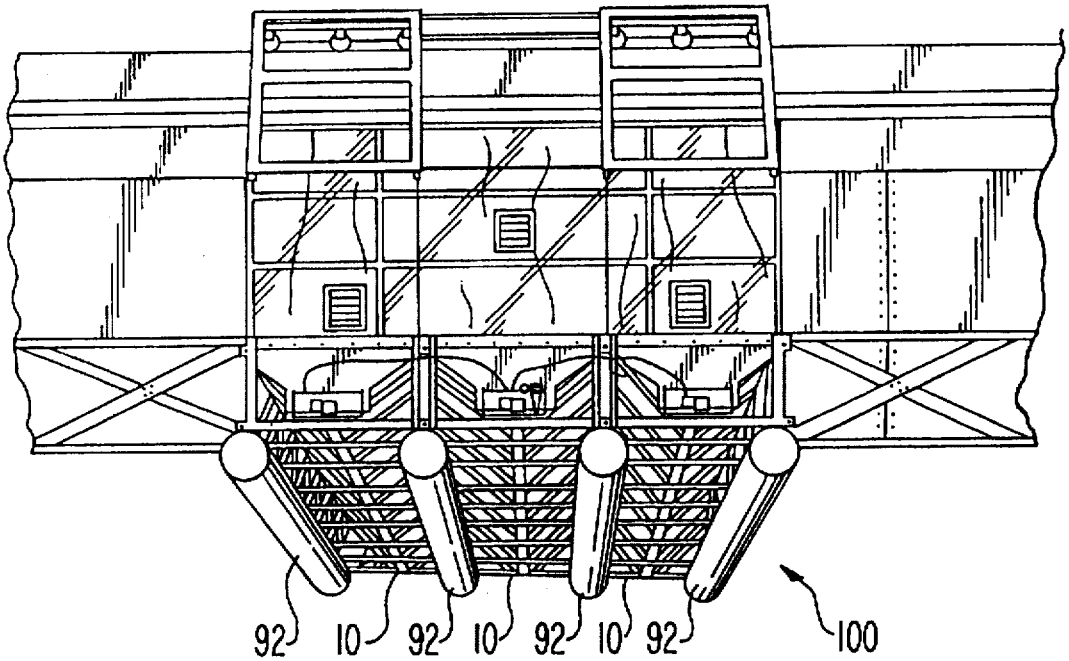
FIG. 2 is a perspective view of the left side of FIG. 1.
Figure 3:
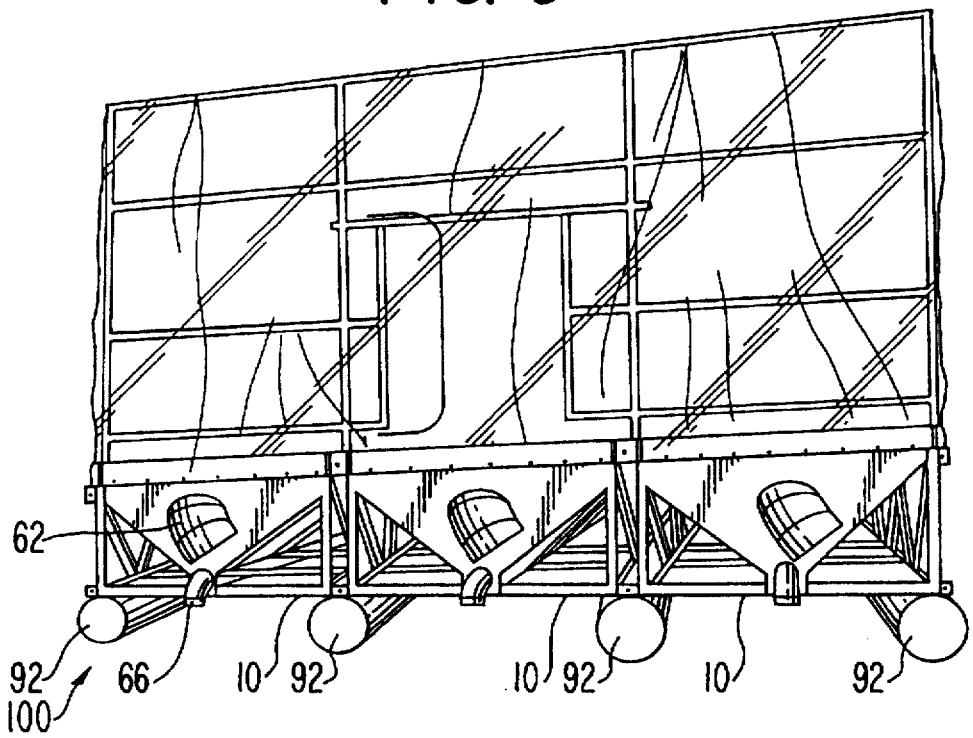
FIG. 3 is a perspective view of the right side of the work platform assembly of FIG. 1.

One embodiment of work platform assembly 100 is pictured in FIGS. 1–3, and is shown suspended by a bridge 2 having one or more surfaces to be treated. Work platform assembly 100 preferably includes a base comprised of a plurality of interconnected modules 10 which can be connected in end-to-end and side-by-side relationships to adjacent modules. FIGS. 1–3 depict assembly 100 as including a two-by-three array of six interconnected modules 10, two in an end-to-end relationship, and three in a side-by-side relationship. However, it is recognized that any desired module configuration could be used.

Figure 4:
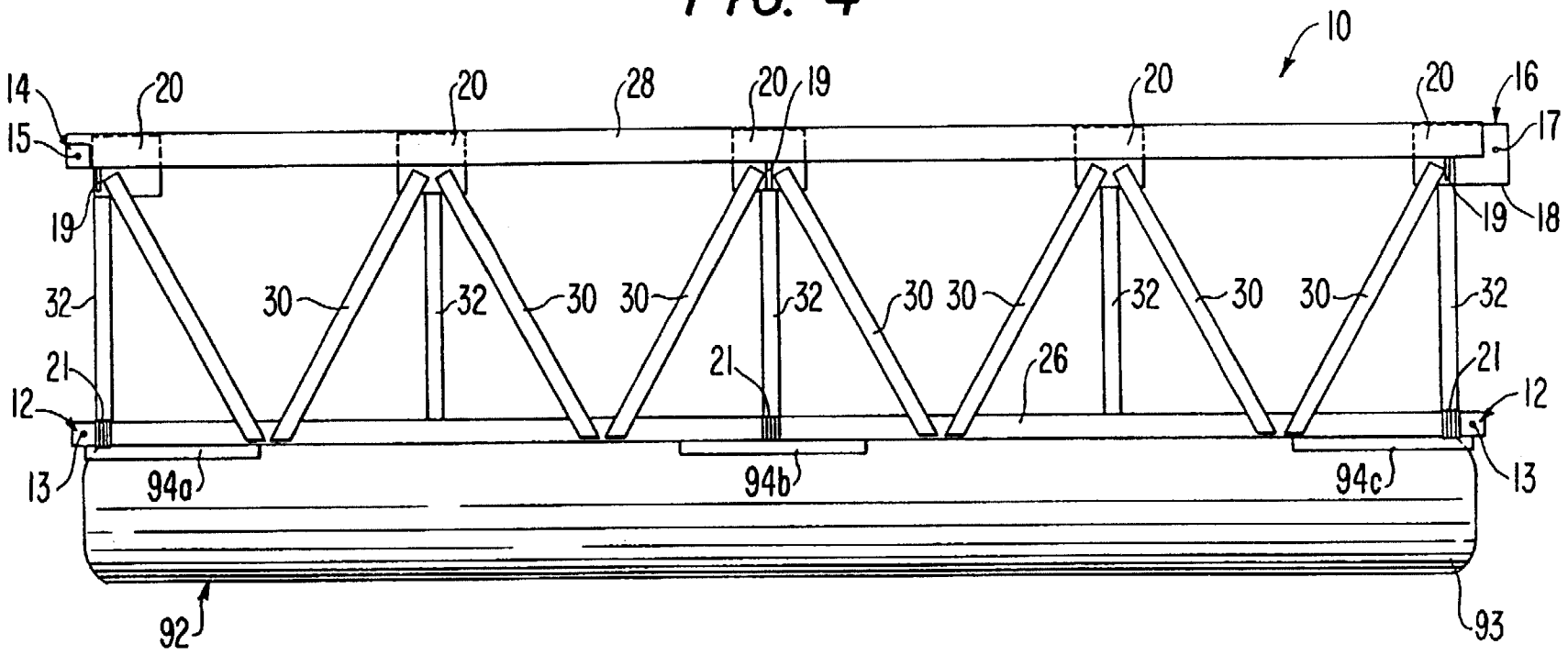
FIG. 4 is a side elevational view of a module from the work platform assembly, with its floatation devices attached thereto.

With reference to FIGS. 4–15, each module 10 comprises a side truss structure extending lengthwise and along each side. As seen in FIG. 4, each such side truss has a top chord 28 and a bottom chord 26. As seen in the cross-sectional view of FIG. 5, top chord 28 is made up of two C-beams which are spaced apart, back-to-back, by gussets 20 which also provide points of attachment between the C-beams at several locations along the length of the chord 28. Lower chord 26 is an inverted T-beam. L-beams 32 extend vertically between top chord 28 and bottom chord 26, with L-beams 30 extending diagonally between top chord 28 and bottom chord 26, as seen in FIG. 4.

Figure 5:
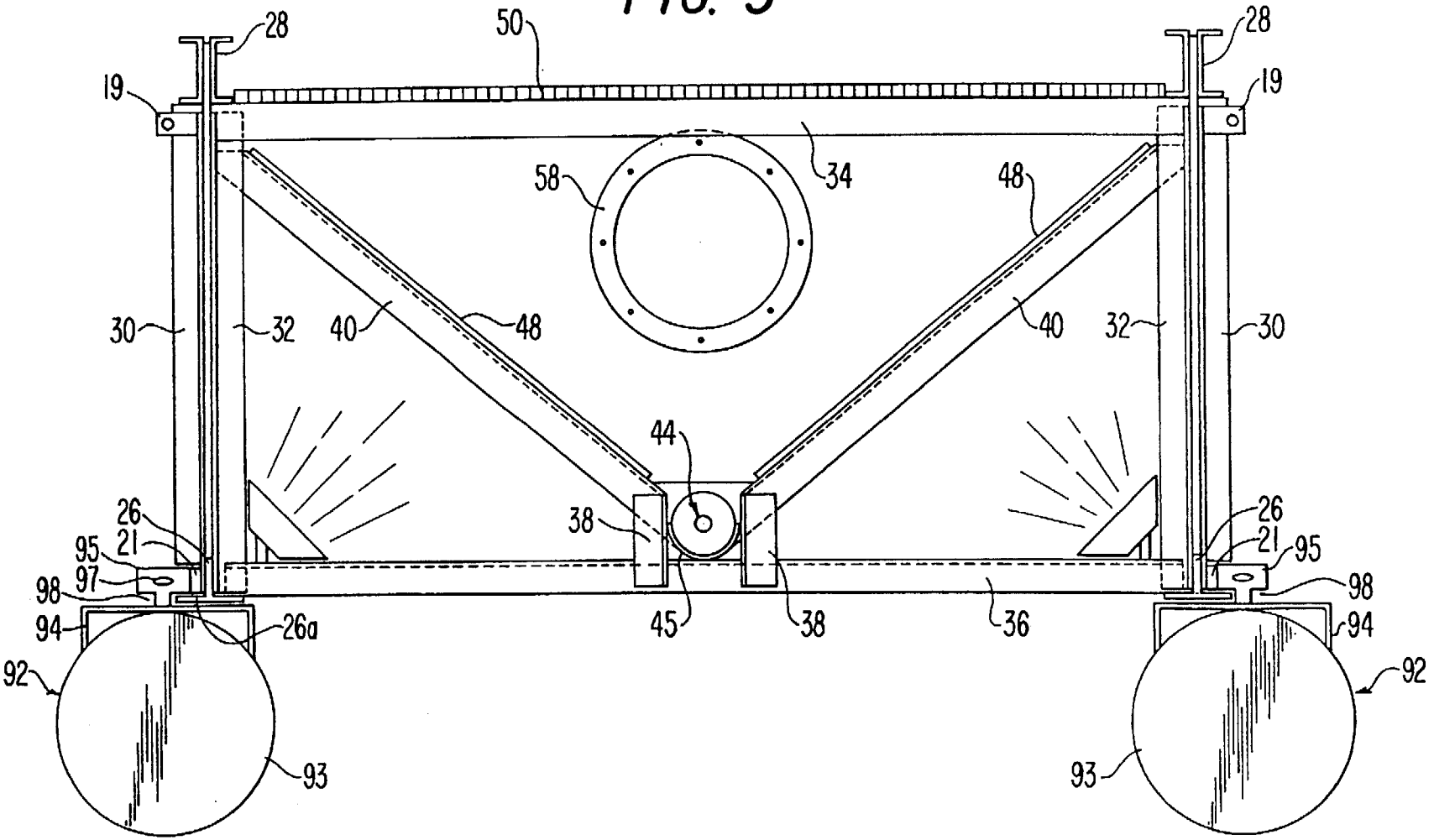
FIG. 5 is an end elevational view of the module of FIG. 4.
Figure 6:
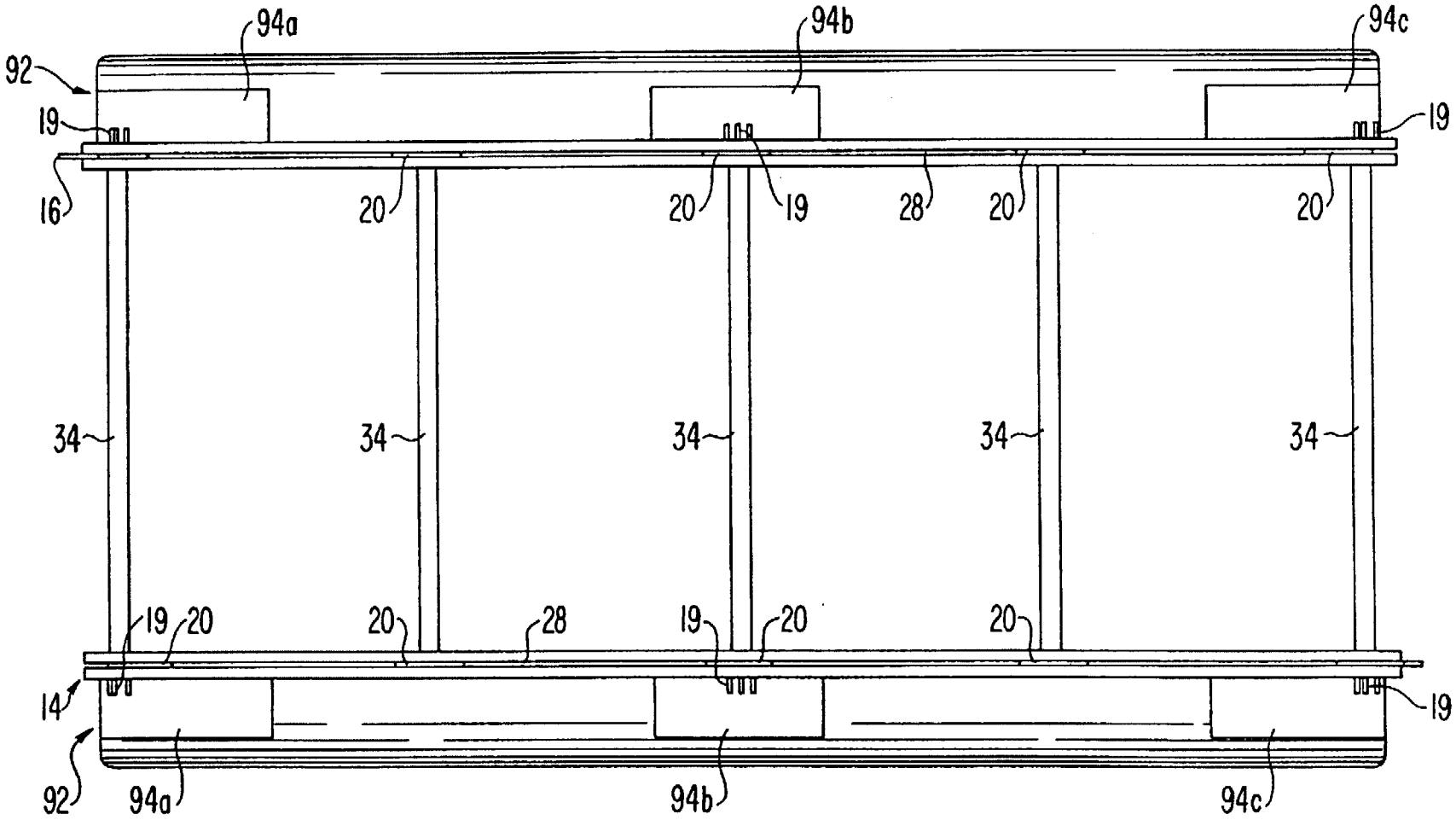
FIG. 6 is a partial top plan view showing the relationship between the module frame and the floatation devices.
Figure 7:
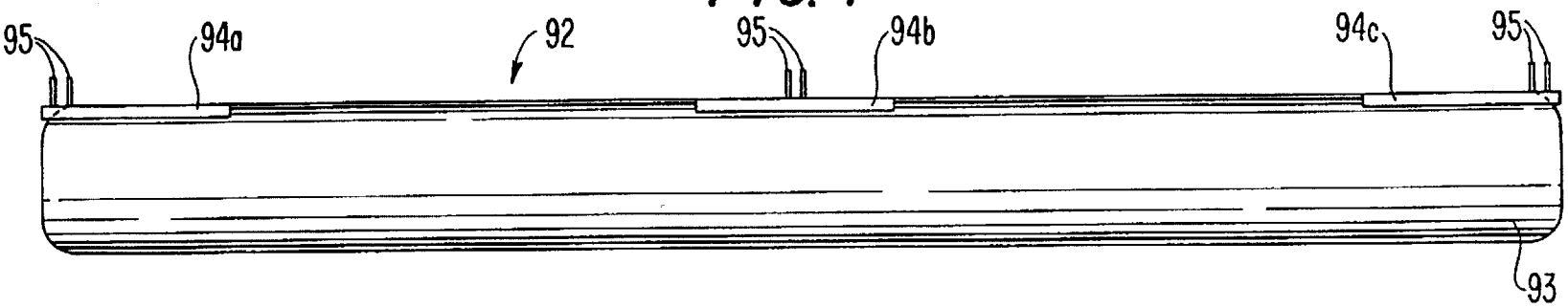
FIG. 7 is a side elevational view of the floatation device.
Figure 8:
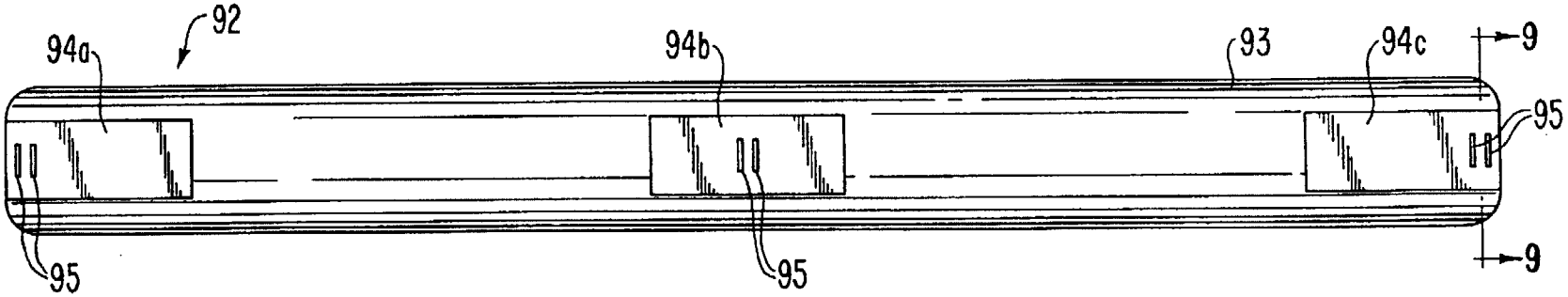
FIG. 8 is a top plan view of the floatation device of FIG. 7.

Referring to FIGS. 5 and 6, each module 10 also has upper lateral L-beams 34 and lower lateral L-beams 36 extending between the side truss structures. Beams 34 and 36, in combination with the short center posts 38 and lateral diagonal beams 40, provide a lateral truss structure which is oriented perpendicular to the planes of the side truss structures.

Figure 14:
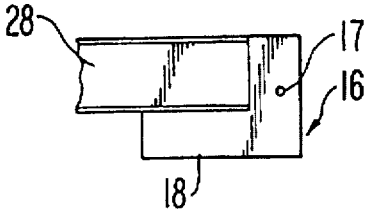
FIG. 14 is a partial elevation of a protruding connection point for the top chord.

Referring particularly to FIGS. 4–6, 13, and 14, each top chord 28 has a "protruding connection point" 16 on one end thereof and a "flush connection point" 14 on the other end thereof. The flush connection point 14 preferably comprises aligned holes 15 through the back-to-back C-beams of top chord 28. Aligned holes 15 are slightly inwardly spaced from the end of top chord 28, as been seen in FIGS. 4 and 13. The protruding connection point 16 is provided by an end connection plate 18 which has a hole 17 therein. End connection plate 18 is attached to the end of the C-beams opposite flush connection point 14, as best seen in FIGS. 4 and 14. Thus, when connecting top chords 28 in series, i.e., end-to-end, end connection plate 18 of protruding connection 16 fits between C-beams of flush connection point 14 whereby holes 15 and 17 are aligned for reception of a pin (not shown) to complete the connection. It should be noted that the positioning and design of the connection points for top chord 28, as disclosed herein, slightly differ from their counterparts disclosed in U.S. patent application Ser. No. 08/172,925. However, it is recognized that the arrangement disclosed in U.S. patent application Ser. No. 08/172,925, as well as other suitable arrangements, could be used.

Figure 15:
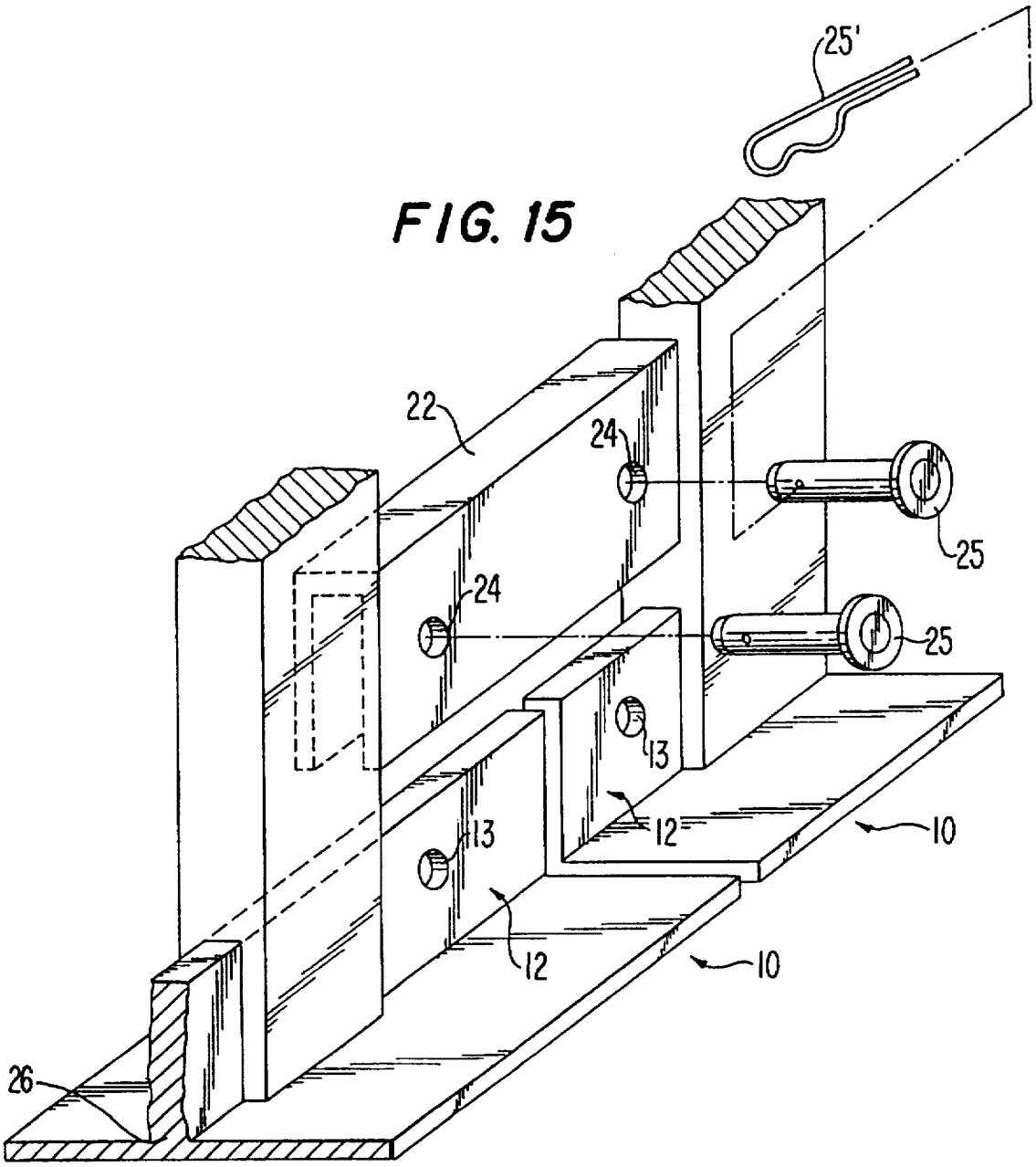
FIG. 15 is a perspective, partially exploded view of the special connection of two bottom chords end-to-end.

With particular reference to FIGS. 4 and 15, each longitudinal end of bottom chord 26 has a connection point 12 including a hole 13 so that an inverted U-shaped connector 22 may receive vertically protruding portions of end-to-end bottom chords such that holes 24 on connector 22 align with holes 13 of the abutted bottom chords 26. Pins or bolts 25 are inserted into the aligned holes, and hairpin spring clips 25' or the like are used to complete the connection. In general, unless otherwise noted, pins 25 and clips 25' or the like are used at all connection points on platform assembly 100 which require a specific retention device.

Accommodation is provided for the top chord connections 14 and 16 by spacing holes 15 and 17 such that a slight gap will remain between the ends of series connected top chords 28 when fully loaded or stressed to a straightened condition. Such a slight gap will allow connection of top chords 28 end-to-end when they are unloaded and, thus, not face-to-face parallel at the so-called abutting ends.

For the bottom chords 26, a similar accommodation is provided by connector 22. The holes 24 thereof are sized slightly larger than holes 13 of bottom chords 26 and are spaced appropriately from the top of connector 22, as viewed in FIG. 15, so as to accommodate non-parallelism of the faces of the so-called abutting ends of bottom chords 26 when in an unloaded or unstressed condition. It also is provided that the vertically protruding portion of the lower chords 26 engage and abut the inside surface of the top portion of connector 22 when fully stressed or loaded to a straightened or uncambered condition of the chords 26. Thus, each end-to-end group of modules 10 is pinned together at adjacent bottom points 12 and adjacent top points 14, 16.

Each such group of end-to-end modules 10 may also be connected to an adjoining group of end-to-end modules 10 by pinning the side-to-side adjacent modules together at upper side connection plates 19 and lower side connection plates 21, as shown in FIGS. 4, 6, and 10–12. Upper side connection plates 19 and lower side connection plates 21 protrude laterally outward from their top and bottom truss chords 26, 28. Gaps between adjoining ends and sides of modules 10 may be prevented by the use of filler strips, not shown.

Platform assembly 100 is provided with a buoyancy system which is capable of keeping platform assembly 100 afloat in a body of water. Buoyancy system includes a plurality of floatation devices 92, e.g., pontoons, which are removably attached to platform assembly 100. More specifically, floatation devices 92 are longitudinally-oriented and attached to the bottom lateral ends of each module 10 in work platform assembly 100. If platform assembly 100 includes modules 10 connected in a side-by-side configuration, a floatation device 92 is preferably mounted to the bottom lateral ends of each adjacent module 10. Floatation devices 92 displace a sufficient volume of water to provide a resulting buoyancy force which is sufficient to float work platform assembly 100 in a body of water.

As shown in FIGS. 4–9, each floatation device 92 includes an aluminum tube 93, and a connecting or mounting arrangement to mount the tube 93 to work platform assembly 100. The mounting arrangement includes three inverted U-shaped channels 94 fixedly attached to the upper periphery of tube 93. A U-shaped channel **94*a*, 94*c* is located at both longitudinal ends of tube 93, while a U-shaped channel 94*b* is located in the longitudinal center of tube 93**.

Each U-shaped channel 94 includes a pair of longitudinally spaced, vertically extending, connector plates 95 attached thereto. Each connector plate 95 includes a horizontal coupling slot 97 and a pair of lower chord locking ledges 98 therein for attachment to modules 10, as described hereinafter.

Lower side connection plates 21 of each module 10 protrude laterally outward from the bottom truss chords 26 of side-by-side adjacent modules 10, and extend between a respective pair of spaced connector plates 95. Each lower side connection plate 21 includes a hole, not shown, which aligns with horizontal coupling slots 97 of its respective spaced connector plate 95 pair.

Floatation devices 92 are positioned at the lower lateral periphery of work platform assembly 100, and a connector pin 77 is inserted through each aligned hole and slot 97 group to retain the floatation devices 92 to a respective bottom lateral end of module 10. A clip and pin hole arrangement, similar to the arrangements shown in FIGS. 10 and 15, is used to retain pin 77 within the aligned hole and slots.

Figure 12:
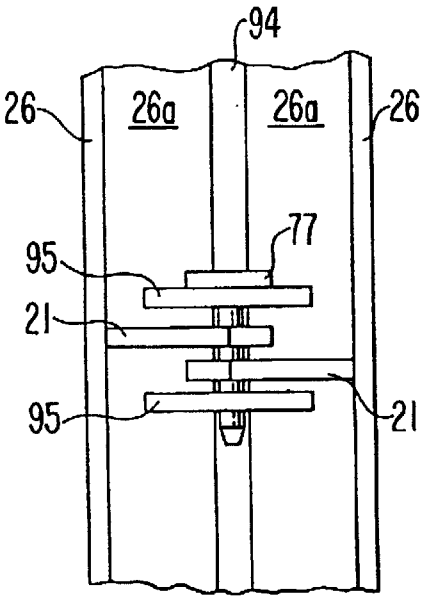
FIG. 12 is a top plan view of the interface between two laterally adjacent modules and a floatation device shown in FIG. 10.
Figure 11:
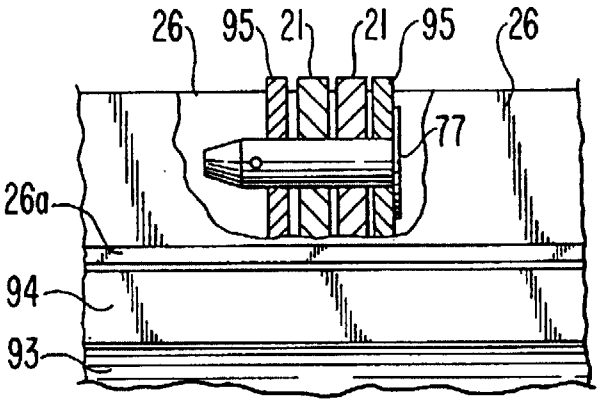
FIG. 11 is a side view of the interface between two laterally adjacent modules and a floatation device shown in FIG. 10.

Floatation devices 92 are also mounted between side-by-side connected modules 10. Lower side connection plates 21 of the adjacent modules 10 extend between a respective pair of spaced connector plates 95, as shown in FIGS. 10–12. Adjacent lower side connection plates 21 include a hole, not shown, which align with each other, and with horizontal coupling slots 97 of their respective spaced connector plate 95 pair. A connector pin 77 is inserted through the four aligned holes and slots to retain the lower ends of the adjacent modules 10 together, and to a common floatation device 92. A clip, not shown, is used to retain pin 77 within the aligned hole and slots.

Figure 9:
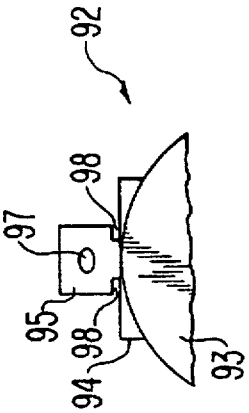
FIG. 9 is a cross-sectional view taken through line 9—9 of the floatation device of FIG. 8.
Figure 10:
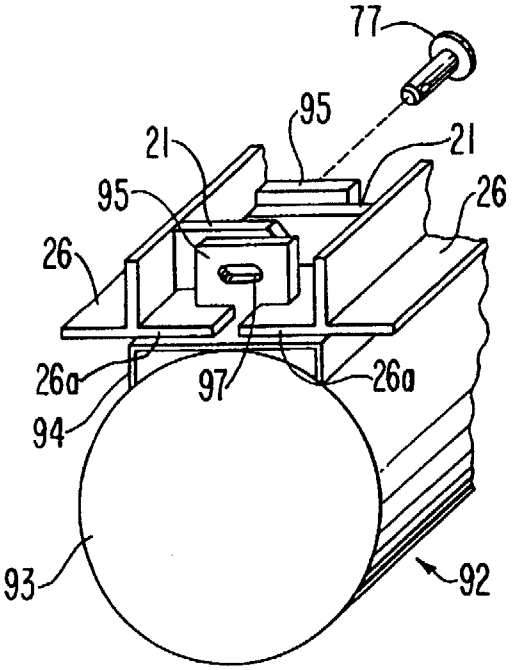
FIG. 10 is a perspective view schematically depicting the interface between two laterally adjacent modules and a floatation device.
Figure 13:
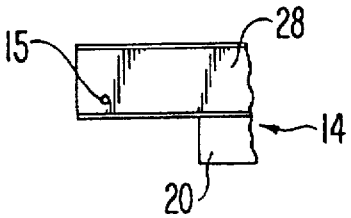
FIG. 13 is a partial elevation of a flush connection point for the top chord.

As shown in FIGS. 5, 9, and 10, locking ledges 98 include slots between the body of connector plate 95 and the top surface of inverted U-shaped channels 94. Along the lateral ends of work platform assembly 100, the hole in each lower side connection plate 21 is aligned with respective coupling slots 97, and outwardly directed horizontal flanges **26*a* are each located in a respective locking ledge 98. As seen in FIG. 10, horizontal flanges 26*a* of laterally adjacent modules 10 are positioned in opposing locking ledges 98 of respective connector plates 95 for floatation devices 92 mounted between modules 10 connected in a side-by-side configuration. This interface between the horizontal flanges 26*a* of bottom chords 26 and locking ledges 98 helps to stabilize the connections between adjacent modules 10, and the connection with their common floatation device 92**.

In the preferred embodiment, tube 93, channels 94 and connector plates 95 are comprised of aluminum, and are attached to each other by any suitable manner. However, other materials and connection arrangements could be used. For example, tube 93 could be made from other metals, plastics, or any other suitable material. Additionally, while tubes 93 are utilized to provide the desired buoyancy force, other types of floatation devices could be used to provide the desired buoyancy force, without departing from the spirit of the invention. For example, it is contemplated that floatation devices 92 could be made from a foam material, and optionally coated or enclosed by plastic, wood, or fiberglass. Additionally, inflatable members, e.g., rubber tubes, could be used to provide the desired buoyancy force. Further, while the floatation devices 92 are preferably all distinct elements separately attachable to modules 10 for assembly design flexibility, it is recognized that floatation system can be designed as one or more larger floatation devices to reduce the quantity of parts or assembly time.

As best shown in FIG. 5 each module 10 further includes a removable grating 50 supported by beams 34 for workers to stand upon and walk to address the metal surfaces to be treated, e.g., stripped and recoated. Angled wall panels 48 define a V-shaped hopper located below grating 50 which extends the full length of module 10. The bottom apex of the hoppers include a semi-circular pipe housing 45 which houses an auger section 44, i.e., a mechanical screw conveyor. Housings of adjacent end-to-end modules 10 are connected, while the housings of adjacent side-by-side modules 10 are independent. The auger sections 44 form a complete auger string resulting from the end-to-end connection of modules 10. Each auger string is driven by a motor 46, preferably pneumatic, at one end. Work platform assembly 100 further includes an enclosure, as shown in FIGS. 1–3, which serves to visually define boundaries of the work platform and to prevent toxic dust and particulates resulting from the blasting process from contaminating or otherwise affecting the environment.

Also, as seen in FIG. 1, an elbow 66 is attached at the end of each auger string 44 to receive the particulate material exiting from the enclosure. A conduit may be attached to each of the elbows 66, and a vacuum can be utilized to remove the particulate material that has been moved out of the module troughs via its auger string 44. One end of each module 10 also has an exhaust port 58 which is positioned below the grating 50 and above the auger 44. Work platform assembly 100 may have an elbow 62 attached to exhaust port 58 to facilitate connection of large vacuum hoses for exhausting airborne particles and dust from the modules 10.

Suspension of a platform below a bridge is illustrated in FIG. 1, in which suspension frames 80 mount on, and are rollable along, Jersey wall-type parapets 6, by wheels 82, 88, and 90. Suspension system allows movement of platform assembly 10 along the length of a bridge for step-by-step blasting and/or painting the surfaces of the metal structure supporting the bridge.

Referring to FIG. 1, cables 96 suspend the platform 10 from each suspension frame 80, with cables 96 being coplanar with the line of travel of top wheels 88 so as to provide vertical loading of the platform suspension on parapets 6. Although not shown, winches may be provided on either of the suspension frame 80 or the platform 10 in order to raise and lower the platform relative to the bridge. A series of suspension frames 80 may be attached together in the direction of the length of the bridge, or alternatively, the middle suspension frame for each end of the platform assembly may be replaced by linkage as illustrated in FIG. 2. Details of the suspension system shown in FIG. 1, and of an alternative suspension system, are described in U.S. patent application Ser. No. 08/172,925, which has been incorporated by reference herein. Further, it is recognized that platform assembly 100 can be used with any suspension system suitable for suspension from a structure having a surface to be treated, and is not limited for use with the suspension systems disclosed herein or in U.S. patent application Ser. No. 08/172,925.

In operation, the bridge deck surfaces can be treated with blast media. While the surfaces are being treated, work platform assembly 100 separates heavy particulate material from the airborne residue and evacuates each from the enclosure. The heavier residue and particulate material used during the blasting process fall down through the grating 50 and into the troughs under the force of gravity. The heavier residue and particulate material are then positively driven out of the enclosure and into the elbow 66 by the auger 44. A vacuum applied to elbow 66 moves the material already inside the elbow, i.e., outside the enclosure, to a residue separation system for recycling and/or reconditioning. The airborne residue is evacuated from the enclosure by a vacuum applied to elbow 62, into a dust collection system, for subsequent disposal in a manner which does not contaminate the environment.

The floatation/buoyancy system on work platform assembly 100 provides numerous advantages relating to the transport, manipulation, and the use of the work platform assembly. To transport work platform assembly 100 to a structure located above a body of water, the work platform assembly 100 could be shipped to a dock adjacent the structure and floated in the water. The floating assembly 100 is transported in the water to the desired position by manually pulling the work platform assembly, by towing the work platform assembly with a small boat, or by mounting a motor to the work platform assembly. The work platform assembly is horizontally positioned under the desired surface to be treated, cables 96 are extended between the work platform assembly and the structure, and the work platform assembly is raised with the floatation devices 92 thereon. A winch is used to vertically raise the work platform assembly to the surface to be treated.

Many structures having surfaces to be treated include piers or other vertically oriented supports which prevent easy manipulation of the work platform assembly along the structure. Prior solutions to avoid these physical constraints was costly, time consuming, or otherwise not desirable. As work platform assembly 100 can float in the body of water, manipulation of the work platform assembly is now simpler. To maneuver work platform assembly around a physical constraint, e.g., a pier, the work platform assembly is lowered from a position adjacent a first surface of the structure to the body of water, and floated directly on the body of water. The floating work platform assembly is translationally moved, manually if possible, around the pier. The suspension system supported by the structure is shifted to a second surface to be treated, and the supporting cables 96 are detached and reattached to avoid tangling. The work platform assembly is raised to a position adjacent the second surface of the structure, where it can be treated as desired.

The inclusion of the floatation system also permits the work platform assembly to be used to treat surfaces while it is floating on a body of water. This is extremely beneficial when the surfaces to be treated are in close proximity to the top of the body of water. In such situations, the floating work platform assembly 100 is positioned in the water adjacent a surface to be treated. The work platform assembly 100 is stabilized with respect to the structure by dropping an anchor, utilizing a drift pin, or any other arrangement used to secure floating barge type devices. In the alternative, work platform assembly 100 can be stabilized with respect to the structure by attaching a cable between the work platform assembly 100 and a fixed structure, preferably the structure which contains the surface to be treated. Once the work platform assembly 100 is stabilized, the surface can be treated as desired.

Additionally, while work platform assembly 100 is shown and described for removing of rust and paint from bridges by blasting the metal surfaces with particles, it is recognized that work platform assembly 100 can be used for many other types of treatments and on other types of structures. For example, workers can also use work platform assembly 100 as a supporting structure to blast paint particles on a surface, i.e., to paint.

Additionally, the surfaces to be treated can be located on any structure. As work platform assembly 100 includes a floatation system, it is particularly advantageous for treating surfaces on other structures located in bodies of water, e.g., drilling stations, tanks, off-shore rigs, boats, etc.

Further, work platform assembly 100 need not include the depicted screw conveyor or vacuum conveyor, and other types, variations, or combinations of conveying systems could be used to remove particles from the assembly.

In addition, upper end connection points 14 and 16 and lower end connection points 12 of work platform assembly 100 may be also used to interface with a trailer, as described in U.S. patent application Ser. No. 08/340,306, which has been incorporated by reference herein. The trailer 200 is particularly useful in transporting and vertically positioning work platform assembly 100 to and from particular locales on roads and highways.

Additionally, work platform assembly 100 may also include extension wing frame panels, as shown in U.S. patent application Ser. No. 08/340,306, which has been incorporated by reference herein. Extension wing frame panels extend longitudinally along modules 10 and are pivotally attached to top chords 28. Extension wing frame panels laterally extend the dimensions of work platform assembly 100 to address a larger area of the surfaces to be treated.

While particular embodiments of the invention have been shown and described, it is recognized that various modifications thereof will occur to those skilled in the art. Therefore, the scope of the herein-described invention shall be limited solely by the claims appended hereto.

I claim:

1. A work platform assembly positionable at and spanning an underside of a structure located above a body of water to provide worker support and access to and treatment of surfaces of the structure, the work platform assembly comprising:

a body, said body includes a bottom periphery and an assembly frame;

a trough for collecting particulate material;

worker supporting structure positioned atop said trough for supporting a worker thereon;

a conveyor system for discharging the particulate material from the trough; and a buoyancy system structurally coupled to said body, said buoyancy system providing the work platform assembly with sufficient buoyancy to permit the work platform assembly to float in the body of water below the surface to be treated, said buoyancy system includes a plurality of floatation members positioned adjacent the bottom periphery of the said body of the work platform assembly and being removably attached to said assembly frame, said floatation members being transportable with said work platform assembly to a position adjacent the surface to be treated, each said floatation member includes a floatation imparting device and at least one platform fastening plate attached to said floatation imparting device, said fastening plate being removably attached to said assembly frame of said work platform assembly;

said floatation device fastening plate including a generally horizontally oriented slot therein, said body of said work platform assembly further includes a generally horizontally oriented flange, said flange being insertable into said slot for restraining the movement of said flange with respect to said floatation member.

2. A platform assembly as in claim 1, said body of said work platform assembly includes a bottom periphery, said buoyancy system including a plurality of floatation members positioned adjacent the bottom periphery of the said body of the work platform assembly.

3. A work platform assembly positionable at and spanning an underside of a structure located above a body of water to provide worker support and access to and treatment of surfaces of the structure, the work platform assembly comprising:

at least first and second modules, said first and second modules being connected together, each said first and second module including: a frame, means for connecting said modules together side-to-side by connecting corresponding frames of said modules together side-to-side, a trough attached to said frame and extending longitudinally of said module, worker supporting structure positioned atop said trough for supporting a worker thereon, and a conveyor system for discharging said particulate material from said trough;

a buoyancy system structurally coupled to at least one of said first and second modules, said buoyancy system providing the work platform assembly with sufficient buoyancy to permit the work platform assembly to float in the body of water below the surface to be treated, said buoyancy system including at least one floatation member immovable with respect to the first and second modules of the work platform assembly when coupled thereto such that the floatation member is vertically transportable with said first and second modules of the work platform assembly to a position adjacent the surface to be treated;

said connection means including an attachment device which attaches the modules together and attaches the floatation member to the modules.

4. A platform assembly as in claim 3, said floatation member includes a gas-tight containment member.

5. A platform assembly as in claim 4, said gas-tight containment member is an aluminum tube.

6. A platform assembly as in claim 4, said connection means including a plurality of coupling brackets fixedly coupled to said gas-tight containment member.

7. A platform assembly as in claim 1, wherein the treatment of the surfaces comprises projecting abrasive particles onto surfaces of bridge decks in order to remove material therefrom, said treatment also resulting in loose, spent abrasive particles and residue, said work platform assembly including an enclosure and sealing means being positionable adjacent to the underside of the bridge deck for forming an enclosure covering areas between the work platform assembly and the bridge deck underside, the enclosure substantially blocking the spent abrasive particles and residue from entering a surrounding environment outside of the platform assembly.

8. A platform assembly as in claim 3, wherein said trough includes a trough outlet, said conveyor system includes a mechanical conveyor which conveys said particulate material longitudinally along said trough to said trough outlet.

9. An apparatus as in claim 3, wherein each said first and second module further includes side trusses extending longitudinally of said module, and lateral beams connecting said side trusses together, said connecting means connecting adjacent side trusses of adjacent modules together.

10. An apparatus as in claim 9, wherein said connecting means includes a connection member and connector receiving holes located in said frames, said connector receiving holes sufficiently sized to receive said connection member, wherein said connector member penetrates said connector receiving holes for attaching the modules together.

11. An apparatus as in claim 10, said floatation member including an attachment member for attachment to said connected modules, said attachment member including a connector receiving hole therein, said connector receiving hole being sufficiently sized to receive said connection member, wherein said connector member penetrates said connector receiving holes of said attachment member and said connecting means for attaching the modules together and for attaching the floatation member to the modules.

12. A platform assembly as in claim 3, said floatation member includes a floatation imparting device and at least one platform fastening plate attached to said floatation imparting device, said fastening plate being removably attached to said frames of said connected modules.

13. A platform assembly as in claim 12, said floatation imparting device includes a gas-tight containment member.

14. A platform assembly as in claim 13, each said module frame having opposing bottom longitudinal sides, buoyancy system further including a plurality of floatation members, each said bottom longitudinal side of each said module frame including a floatation member attached thereto.

15. A platform assembly as in claim 3, said work platform assembly further comprising cables coupled thereto for raising and lowering the work platform assembly with respect to the underside of the structure.

16. A platform assembly as in claim 3, said work platform assembly includes opposing lower sides, said buoyancy system including a plurality of floatation members extending substantially along the entire length of each lower side of the work platform assembly.

* * * * *